US007229187B2

(12) United States Patent
Packard et al.

(10) Patent No.: US 7,229,187 B2
(45) Date of Patent: Jun. 12, 2007

(54) COMPACT ILLUMINATION SOURCE WITH NOVEL ACTUATOR

(76) Inventors: David Packard, 32 DeerField Rd., Shrewsbury, MA (US) 01545; Keith Michael Rosiello, 32 Deerfield Rd., Shrewsbury, MA (US) 01545

( * ) Notice: Subject to any disclaimer, the term of this patent is extended or adjusted under 35 U.S.C. 154(b) by 99 days.

(21) Appl. No.: 11/149,992

(22) Filed: Jun. 10, 2005

(65) Prior Publication Data

US 2006/0018121 A1 Jan. 26, 2006

Related U.S. Application Data

(60) Provisional application No. 60/578,702, filed on Jun. 10, 2004.

(51) Int. Cl.
*F21L 4/02* (2006.01)
*F21V 33/00* (2006.01)

(52) U.S. Cl. ..... 362/184; 362/205; 362/249

(58) Field of Classification Search ..... 362/184, 362/202, 205, 249
See application file for complete search history.

(56) References Cited

U.S. PATENT DOCUMENTS 6,386,730 B1 * 5/2002 Matthews ..... 362/184
6,485,160 B1 * 11/2002 Sommers et al. ..... 362/184
6,709,129 B2 * 3/2004 Galli ..... 362/206
7,140,748 B2 * 11/2006 Chien ..... 362/205

* cited by examiner

*Primary Examiner*—Sandra O'Shea
*Assistant Examiner*—Jason Moon Han
(74) *Attorney, Agent, or Firm*—Foley & Lardner LLP; Michel Morency; Ralph Trementozzi

(57) ABSTRACT

The present invention relates to illumination sources. The invention provides a two-part housing including a battery housing component and a lamp housing component, that are adapted to each other. The housing components are sealed, and the illumination source can be controlled by manipulation of the housing components or optionally by pressure on the exterior of the device.

17 Claims, 6 Drawing Sheets

Exploded Perspective View of the Preferred Embodiment.

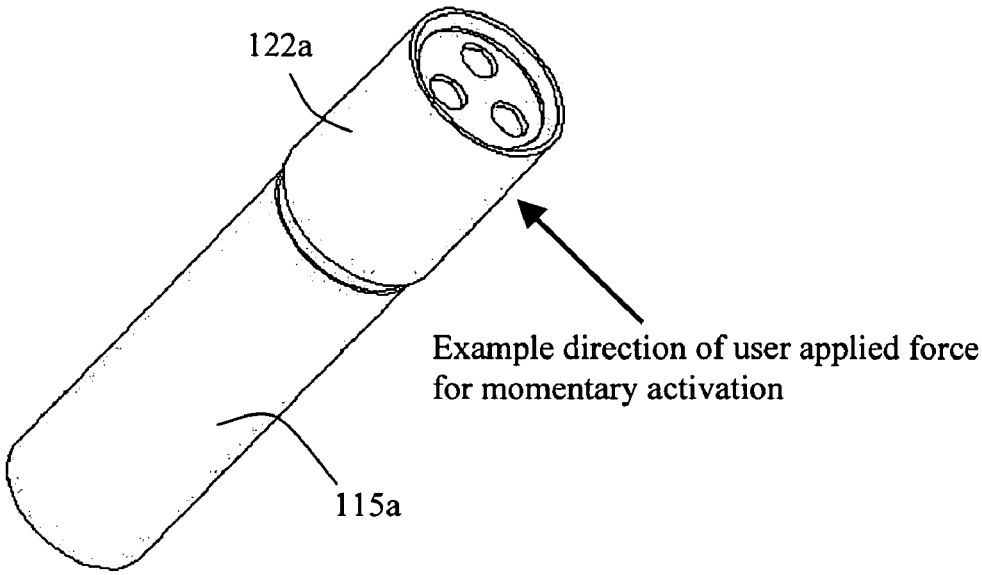
Figure 1A: Perspective View of the Preferred Embodiment, Assembled.

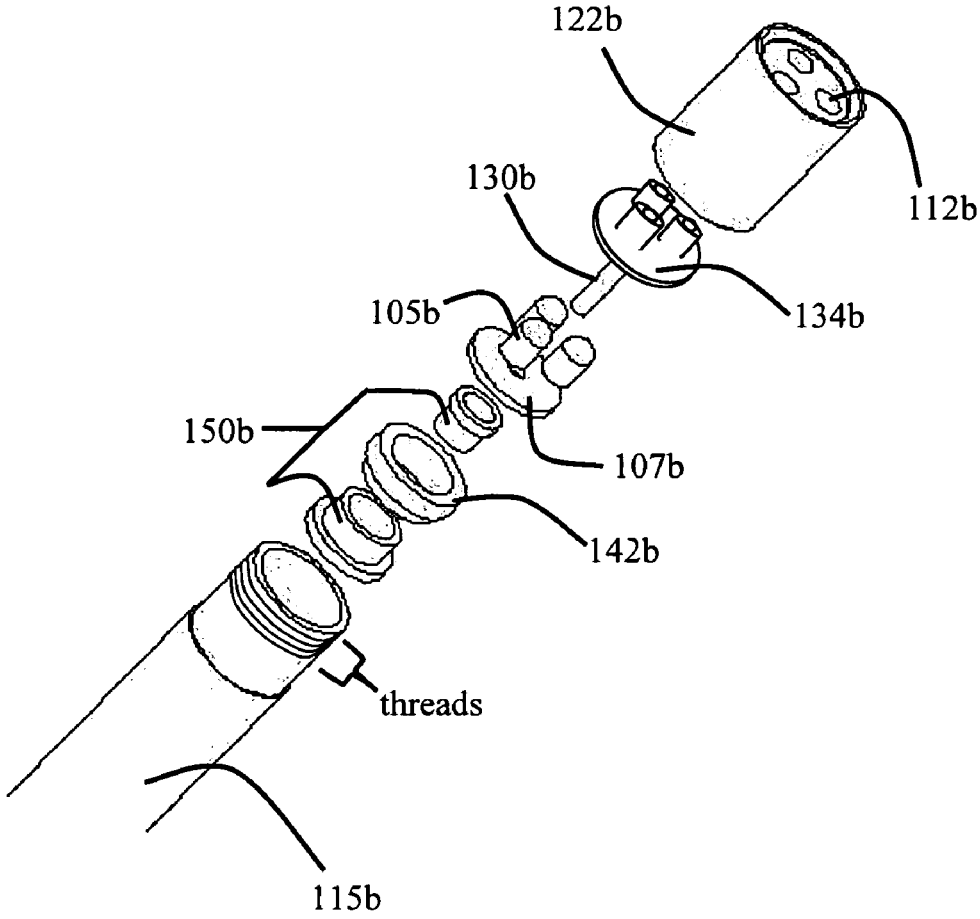
Figure 1B: Exploded Perspective View of the Preferred Embodiment.

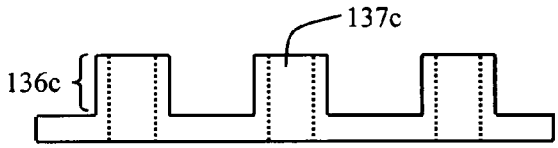
Figure 1C: Detail View of the Novel Gasket Component from the Preferred Embodiment.

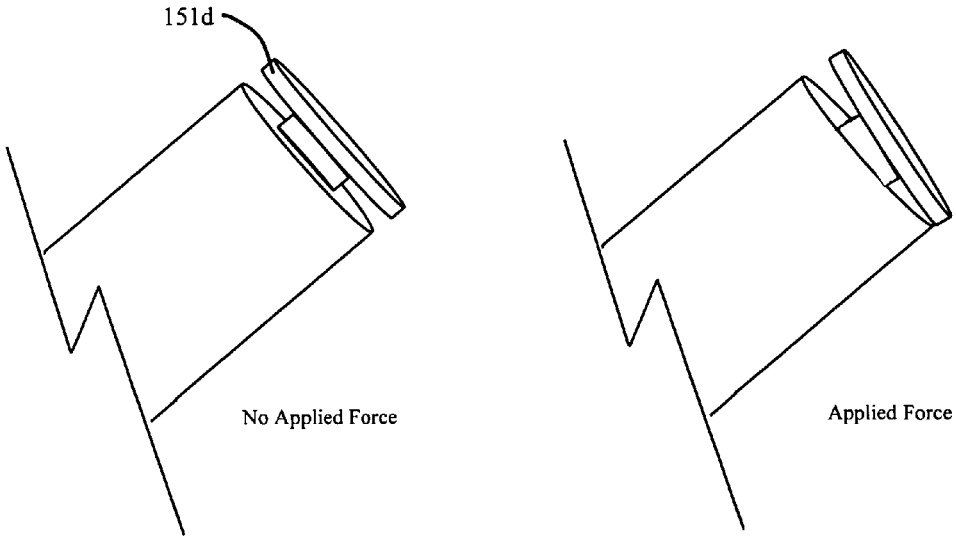
Figure 1D: Detail View of the Electrical Connector Components in the Novel Rocking Momentary Switch

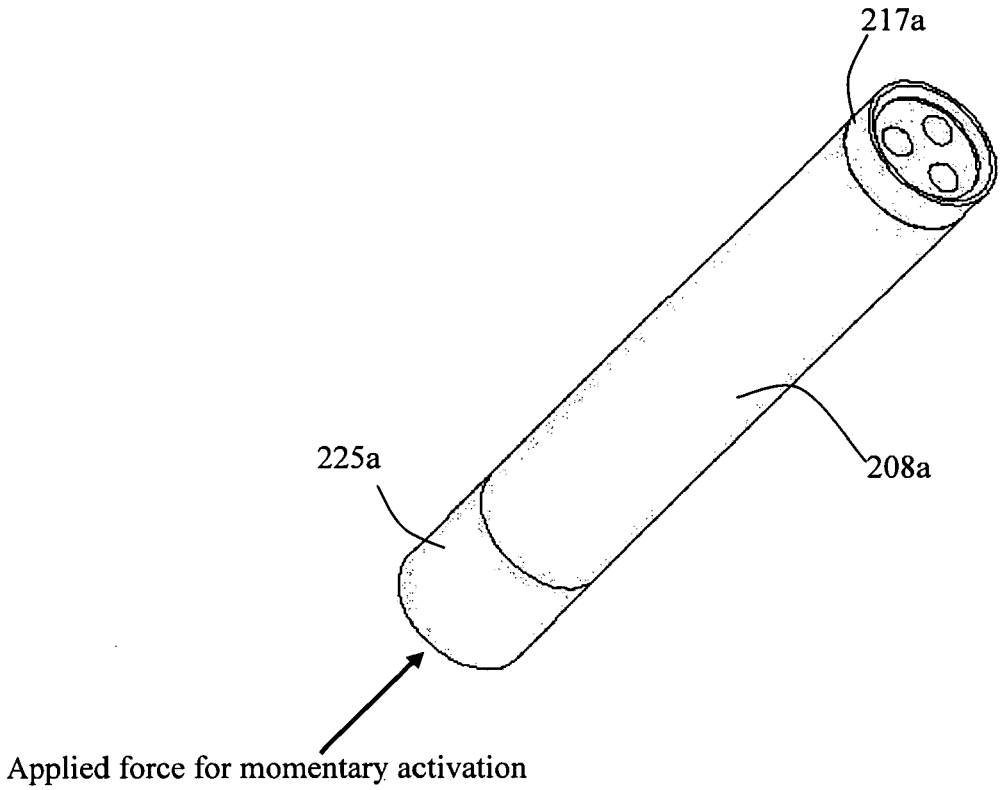
Figure 2A: Perspective View of Other Embodiment, Assembled

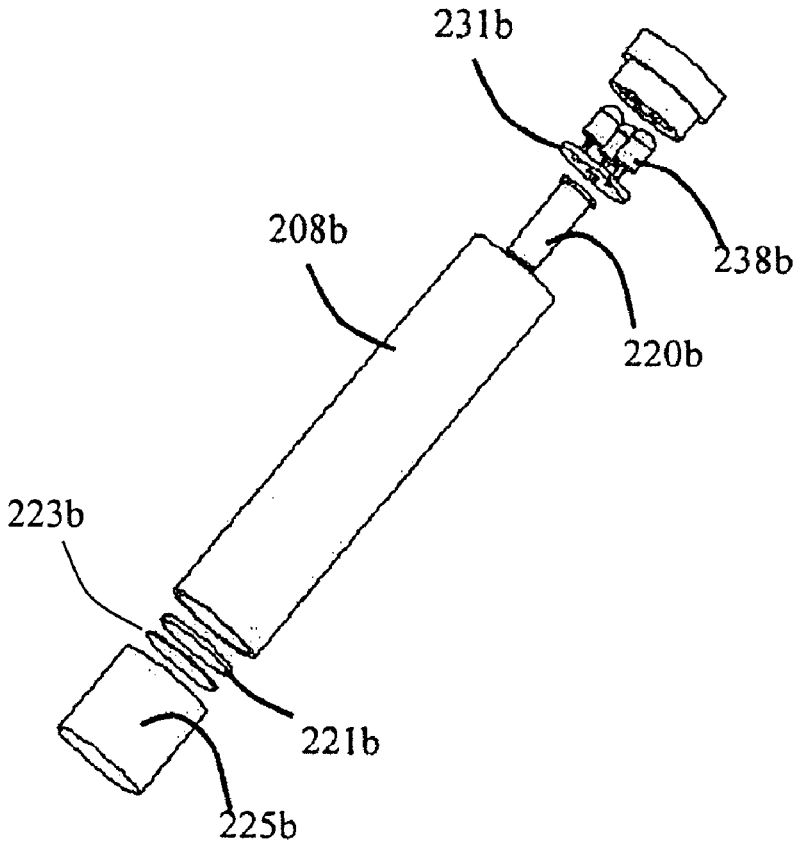
Figure 2B: Exploded Perspective View of Other Embodiment

COMPACT ILLUMINATION SOURCE WITH NOVEL ACTUATOR

FIELD OF THE INVENTION

The present invention relates to illumination sources.

RELATED APPLICATIONS

This application claims priority to U.S. Ser. No. 60/578,702 filed Jun. 10, 2004, the entirety of which is hereby incorporated herein by reference.

BACKGROUND

Flashlights are well-known devices that provide a portable source of illumination. Generally, flashlights are comprised of the following components: a housing, a portable power source, one or more light sources, an activation switch, and optionally control circuitry. The basic modes of operation for the common flashlight are a selectable power on state or power off state. Flashlights with unique features or functionality are known in the art. Changes to these devices generally focuses on the particular physical form or characteristic of the housing of the device, but the functionality remains basic. Other functional innovations with the flashlight include, an integrated rechargeable power source (U.S. Pat. No. 6,183,105), an inline rotational activation switch (U.S. Pat. No. 6,168,288 B1), or a dual-mode operation (U.S. Pat. No. 6,709,129), each incorporated herein by reference in their entireties.

SUMMARY OF THE INVENTION

The present invention improves upon other prior functional innovations with the flashlight by providing a highly functional and reliable flashlight that also possesses a low manufacturing cost. The momentary actuation mechanism of the device of the present invention further improves upon the flashlight by requiring a less specific action from the user to activate the momentary on feature (i.e. can be operated in any orientation).

In one aspect, the illumination device includes: a housing having a battery housing component and a lamp housing component, the battery housing component having threads on one end, further including an inner lumen capable of receiving and containing one or more batteries, and an electrically conductive pathway from the batteries to the lamp housing component; the lamp housing component having a threaded end and a light emitting end, and further including: one or more open ended lumens; interior features; a gasket adapted to the interior features, the gasket having a base that contacts the inner diameter of the lamp housing component, and further comprising one or more protrusions having through holes, the outer surface of the protrusions in contact with the inner surface of the open ended lumens in the lamp housing component; one or more light sources, the light sources positioned through the gasket protrusions and through the open ended lumens; a circuit board, the circuit board in electrical communication with the light sources and the batteries; and a main connector shaft, the shaft positioned axially through the gasket and circuit board capable of securing and holding the lamp housing components; wherein the degree of attachment between the battery housing and the lamp housing through the threaded ends closes or opens the electrical pathway between the light sources and the batteries. In one embodiment, the electrically conductive pathway from the batteries to the lamp housing component is the battery housing component. In another embodiment, the battery housing component is electrically insulated. In a third embodiment, the battery housing component is aluminum, and is anodized on its exterior surface. In a fourth embodiment, the electrical pathway between the light sources and the batteries is open when the degree of attachment between the battery housing and the lamp housing exceeds thirty degrees of rotation. In a fifth embodiment, the electrical pathway between the light sources and the batteries is closed when the degree of attachment between the battery housing and the lamp housing exceeds two but does not exceed thirty degrees of rotation. In a sixth embodiment, the device includes a momentary switch incorporated into the electrical pathway between the light source and batteries. Actuation of the momentary switch by applying pressure to the lamp housing component closes the electrical pathway. In an eighth embodiment, the electrical pathway between the light sources and the batteries is closed when the degree of attachment between the battery housing and the lamp housing exceeds two but does not exceed thirty degrees of rotation, and pressure is applied to the lamp housing component.

In another aspect, the invention includes methods of using the illumination device described consisting of the steps of obtaining the illumination device, rotating the lamp housing component relative to the battery housing component thereby engaging the threads and closing the electrical pathway, and illuminating an object. In one embodiment, the user applies pressure to the lamp housing component thereby closing the electrical pathway, before illuminating the object.

In yet another aspect, the invention provides a method of making an illumination device comprising; obtaining a housing having a battery housing component and a lamp housing component, the battery housing component having threads on one end, further including an inner lumen capable of receiving and containing one or more batteries, and an electrically conductive pathway from the batteries to the lamp housing component; the lamp housing component having a threaded end and a light emitting end, and further comprising: one or more open ended lumens; interior features; a gasket adapted to the interior features, the gasket having a base that contacts the inner diameter of the lamp housing component, and further comprising one or more protrusions having through holes, the outer surface of the protrusions in contact with the inner surface of the open ended lumens in the lamp housing component; one or more light sources, the light sources positioned through the gasket protrusions and through the open ended lumens; a circuit board, the circuit board in electrical communication with the light sources and the batteries; and a main connector shaft, the shaft positioned axially through the gasket and circuit board capable of securing and holding the lamp housing components; and assembling the components thereof. In one embodiment, the invention provides for the inclusion of a momentary switch incorporated into the electrical pathway between the light source and batteries; and a main connector shaft, the shaft positioned axially through the gasket and circuit board capable of securing and holding the lamp housing components; and assembling the components thereof.

DETAILED DESCRIPTION

The present invention provides a compact illumination device (flashlight) with at least two modes of operation, one of which is a typical constant-on mode that is activated with a rotational motion of a housing component. A second mode of operation is a momentary-on (signal) mode, in which the electrical circuit powering the light source remains closed only when an outside force is actively applied to the device housing, creating the ability to easily and repeatedly activate and deactivate the light source.

The compact illumination device is comprised of a multiple piece housing, which contains a substantial inner lumen for the power source, for example two 2016 coin cell lithium 3-volt batteries in series, or one or more AA, AAA, C, or D-cell alkaline batteries or other similar portable power sources and a quality light source such as incandescent bulbs, halogen or xenon bulbs or preferably light emitting diode (LED) lamps with accompanying circuitry. Any of a number of light sources having various wavelength characteristics may be utilized. For example, an infrared, ultraviolet or white light, light sources may be utilized in the flashlight construction. White light is preferred. One or more bulbs can be used.

The superior actuation mechanism is fully integrated in the existing housing components, eliminating the need for switches, push-button, slider, or other activation components. This superior momentary actuation mechanism improves upon conventional mechanisms by simplifying the user input needed for activation, increasing device reliability and lowering the cost of each unit produced.

As shown in FIG. 1A, the preferred embodiment of the disclosed invention takes a substantially cylindrical form. In the preferred embodiment, the housing is a two-part unit that serves to contain and protect all device components, and function as the operation mode selector and momentary activation switch. The threads are an integral component of the momentary actuation mechanism and are class 2 to facilitate this function. The battery-housing component (115*a*) features a substantial inner lumen that contains one or more batteries and positions them such that the battery electrical leads contact one another (in series) or an electrically conductive contact, surface or component of the flashlight. In the preferred embodiment, the interior surface of the battery housing is the electrically conductive surface. The housing is manufactured from an electrically conductive material, such as aluminum, and then the exterior is coated with an insulating material such as aluminum anodize, plastic, ceramic or rubber or other electrical insulating material.

In the preferred embodiment, the lamp-housing component (122*a*) features open-ended lumens to contain the light source(s), shown in the illustration as three luminal spaces capable of receiving the light sources, for example LEDs (light emitting diodes). The interior and exterior of the lamp-housing component is coated with an electrical insulator, such as aluminum anodize. An electrical pathway is formed through the lamp-housing component, thus providing electrical communication between the light sources and the power supply. The lamp-housing component also contains one or more interior features, such as a surface or groove, included specifically to accommodate the placement of a membrane, gasket, o-ring, or other environmental seal for the protection of internal components. The use of such environment seals eliminates the need for common, but inefficient, curing sealant processes, which results in a simpler device assembly and lower manufacturing costs. The preferred embodiment uses a custom-made gasket (134*b*), manufactured from silicone or the like, which in combination with the assembly technique provides multiple seals within the lamp-housing component. The redundant levels of protection provided by the gasket serve to increase the overall reliability of the device while maintaining a low cost of manufacture.

As shown in FIG. 1B, the internal components of the preferred embodiment include light sources, e.g., LEDs (105*b*) mounted on a circuit board (107*b*) in a pattern which mates with the open-ended lumens (112*b*) in the lamp-housing component. The number of LEDs and lumens is variable. The preferred embodiment has three LEDs and lumens. In the preferred embodiment, the circuit board is positioned proximate to the electrically conductive surface or components when the housing components are assembled. An internal shelf or other such feature in the lamp-housing component serves to place and support the circuit board. In the preferred embodiment, a main connector shaft component (130*b*) provides attachment features, such as threaded ends, which mate with a feature in the lamp-housing component, such as a tapped hole. The main connector shaft also serves as a central alignment feature that provides the ability to automate the assembly process, which in turn increases throughput, decreases manufacturing rejects, and lowers manufacturing costs. In the preferred embodiment, the main connector shaft also serves as a base for a coil spring (not shown) that provides a tension force on several components and provides an electrical connection to the circuit board.

As shown in FIG. 1C, the gasket is comprised of a thin base that provides a seal around the inner diameter of the lamp-housing component. The customized gasket used in the preferred embodiment also features a number of cylindrical protrusions (136*c*) that correspond to the open-ended lumens within the lamp-housing component. Each protrusion features a through hole (137*c*) to contain and seal each LED. In addition, the outer diameter of each gasket protrusion forms a seal around the inner diameter of each open-ended lumen.

In the preferred embodiment, the in-line electrical connection between the power source and the light source is compiled of several components that, in combination with the housing components, act as an activation switch. Each of these internal components is constructed from either a conductive (150*b*) or insulating material (142*b*). In the assembled state all components are aligned co-axially. The electrical circuit is closed by the compressive force generated by the lamp housing (122*b*) when the threads are fully engaged with the threads in the battery housing (115*b*). In the preferred embodiment, this fully engaged position of the lamp housing on the battery housing, activates the constant-on operation mode.

A slight counter-rotation (approximately 2–10 degrees) of the lamp housing back from the constant-on position, engages the momentary activation mode. In this mode of operation, the electrical circuit is open and the light is off, until an outside force is applied to the lamp-housing component. In the preferred embodiment, the force activates the rocking momentary switch, closes the circuit, and powers the LEDs. In the momentary on mode, the circuit remains closed only when an outside force is applied, creating the ability to easily and repeatedly activate and deactivate the light source. The rocking momentary switch, in the preferred embodiment, functions due to a combination of the fit classification of the threads and the limited thread length. These factors create a fit between the housing components that when prompted by an applied force allows the lamp housing to be rocked or offset slightly with respect to the battery housing, without compromising the integrity of the assembly.

As shown in FIG. 1D, the angular axial displacement of the lamp housing component causes a similar angular axial displacement of the electrical contact component (151*d*), which, in turn, closes the electrical circuit and powers the LEDs.

The final mode of operation in the preferred embodiment is activated by a significant counter-rotation of the lamp housing (approximately 30 degrees or greater), which creates sufficient axial displacement of the electrical contact component, to open the circuit in a manner that can not be closed by the application of force to the lamp housing. This constant off mode is intended to prevent unintended activation and battery use when the user is not actively employing the device.

FIGS. 2A and 2B show another embodiment of the present invention. This embodiment of the disclosed invention also takes a substantially cylindrical form. In this embodiment, the housing is a three-part unit that is joined using a common mechanism, such as threads. In this embodiment, the three housing components are the battery housing (208*a*), the lamp housing (217*a*), and the end housing (225*a*). The battery-housing component features a substantial inner lumen that contains one or more batteries and positions them such that when assembled the battery electrical leads contact one another or an electrically conductive surface at either end of the lumen. The battery housing, in this embodiment, features an electrically insulating shelf component, either integral or assembled, through which the spring retainer component (220*b*) is inserted. When the device is in an assembled state, the spring retainer and spring (not shown) components maintain electrical contact between the power source and the circuit board (231*b*). The lamp-housing component features multiple, open-ended lumens to contain the light sources, LEDs in this embodiment. Further, in this embodiment, the lamp-housing component contains a tapped hole or similar feature to allow for the attachment of the circuit board assembly. The circuit board assembly, in this embodiment, consists of multiple LEDs mounted to the circuit board, a fastener, the spring, and an insulating sleeve that serves to electrically isolate the fastener head from the adjacent electrical circuit. The lamp housing also includes features, such as integral shelf or groove, to accommodate an environmental seal, such as gasket or o-ring, for the protection of the internal electrical components.

In this embodiment, the end-housing component features an inner lumen, open at one end and closed at the opposite end. An electrically conductive plate component (221*b*) and electrically insulating pad component (223*b*) are inserted in the end-housing component. The electrically conductive plate in the end-housing component is positioned such that contact with one or more battery leads is initiated when the threads joining the end housing to the battery housing are fully engaged. In this fully engaged position, the end-housing component activates the constant on operation mode. In the constant-on operation mode, the force of electrically conductive plate pushes the batteries into contact with the spring retainer component, closes the electric circuit, and delivers constant power to the light source.

A slight counter-rotation (approximately 2–10 degrees) of the lamp housing back from the constant-on position, engages the momentary activation mode. In this mode of operation, the electrical circuit is open and the light is off, until an outside force is applied to the lamp-housing component. In this embodiment, the applied force offsets the end-housing and contained components a sufficient amount to put the batteries into contact with the spring retainer, closing the circuit and powering the LEDs. In the momentary on mode, the circuit remains closed only when and outside force is applied, creating the ability to easily and repeatedly activate and deactivate the light source.

The final mode of operation in this embodiment is activated by a significant counter-rotation of the end housing (approximately 30 degrees), which creates sufficient displacement between the battery lead and the spring retainer component to open the circuit in a manner that can not be closed by the application of force to the end housing. The constant off mode in this embodiment is only overridden by a rotation of the end-housing component to the momentary or constant on positions. This constant off mode is intended to prevent unintended activation and battery use when the user is not actively employing the device.

EQUIVALENTS

From the foregoing detailed description of the specific embodiments of the invention, it should be apparent that unique operational features have been described. Although particular embodiments have been disclosed herein in detail, this has been done by way of example for purposes of illustration only, and is not intended to be limiting with respect to the scope of the appended claims which follow. In particular, it is contemplated by the inventors that various substitutions, alterations, and modifications may be made to the invention without departing from the spirit and scope of the invention as defined by the claims. For instance, the shape and size of the housing, the choice of light spectrum, the addition of electrical control circuitry or the type of power source employed is believed to be matter of routine for a person of ordinary skill in the art with knowledge of the embodiments described herein.

We claim:

1. An illumination device comprising: a housing having a battery housing component and a lamp housing component, the battery housing component having threads on one end, further including an inner lumen capable of receiving and containing one or more batteries, and an electrically conductive pathway from the batteries to the lamp housing component; the lamp housing component having a threaded end and a light emitting end, and further comprising a. one or more open ended lumens;

b. interior features;

c. a gasket adapted to the interior features, the gasket having a base that contacts the inner diameter of the lamp housing component, and further comprising one or more protrusions having through holes, the outer surface of the protrusions in contact with the inner surface of the open ended lumens in the lamp housing component;

d. one or more light sources, the light sources positioned through the gasket protrusions and through the open ended lumens;

e. a circuit board, the circuit board in electrical communication with the light sources and the batteries; and f. a main connector shaft, the shaft positioned axially through the gasket and circuit board capable of securing and holding the lamp housing components;

wherein the degree of attachment between the battery housing and the lamp housing through the threaded ends closes or opens the electrical pathway between the light sources and the batteries.

2. The illumination device of claim 1, wherein the electrically conductive pathway from the batteries to the lamp housing component is the battery housing component.

3. The illumination device of claim 2, wherein the battery housing component is electrically insulated.

4. The illumination device of claim 1, wherein the battery housing component is aluminum, and is anodized on its exterior surface.

5. The illumination device of claim 1, wherein the electrical pathway between the light sources and the batteries is open when the degree of attachment between the battery housing and the lamp housing exceeds thirty degrees of rotation.

6. The illumination device of claim 1, wherein the electrical pathway between the light sources and the batteries is closed when the degree of attachment between the battery housing and the lamp housing exceeds two but does not exceed thirty degrees of rotation.

7. A method of using an illumination device, comprising: obtaining the illumination device of claim 1, rotating the lamp housing component relative to the battery housing component thereby engaging the threads and closing the electrical pathway, and illuminating an object.

8. A method of making an illumination device comprising; obtaining a housing having a battery housing component and a lamp housing component, the battery housing component having threads on one end, further including an inner lumen capable of receiving and containing one or more batteries, and an electrically conductive pathway from the batteries to the lamp housing component; the lamp housing component having a threaded end and a light emitting end, and further comprising: one or more open ended lumens; interior features; a gasket adapted to the interior features, the gasket having a base that contacts the inner diameter of the lamp housing component, and the gasket further comprising one or more protrusions having through holes, the outer surface of the protrusions in contact with the inner surface of the open ended lumens in the lamp housing component; one or more light sources, the light sources positioned through the gasket protrusions and through the open ended lumens; a circuit board, the circuit board in electrical communication with the light sources and the batteries; and a main connector shaft, the shaft positioned axially through the gasket and circuit board capable of securing and holding the lamp housing components; and assembling the components thereof.

9. An illumination device comprising: a housing having a battery housing component and a lamp housing component, the battery housing component having threads on one end, further including an inner lumen capable of receiving and containing one or more batteries, and an electrically conductive pathway from the batteries to the lamp housing component; the lamp housing component having a threaded end and a light emitting end, and further comprising a. one or more open ended lumens;

b. interior features;

c. a gasket adapted to the interior features, the gasket having a base that contacts the inner diameter of the lamp housing component, and further comprising one or more protrusions having through holes, the outer surface of the protrusions in contact with the inner surface of the open ended lumens in the lamp housing component;

d. one or more light sources, the light sources positioned through the gasket protrusions and through the open ended lumens;

e. a circuit board, the circuit board in electrical communication with the light sources and the batteries;

f. a momentary switch incorporated into the electrical pathway between the light source and batteries, and g. a main connector shaft, the shaft positioned axially through the gasket and circuit board capable of securing and holding the lamp housing components;

wherein the degree of attachment between the battery housing and the lamp housing through the threaded ends closes or opens the electrical pathway between the light sources and the batteries.

10. The illumination device of claim 9, wherein actuation of the momentary switch by applying pressure to the lamp housing component closes the electrical pathway.

11. The illumination device of claim 9, wherein the electrically conductive pathway from the batteries to the lamp housing component is the battery housing component.

12. The illumination device of claim 9, wherein the battery housing component is electrically insulated.

13. The illumination device of claim 9, wherein the battery housing component is aluminum, and is anodized on its exterior surface.

14. The illumination device of claim 9, wherein the electrical pathway between the light sources and the batteries is open when the degree of attachment between the battery housing and the lamp housing exceeds thirty degrees of rotation.

15. The illumination device of claim 9, wherein the electrical pathway between the light sources and the batteries is closed when the degree of attachment between the battery housing and the lamp housing exceeds two but does not exceed thirty degrees of rotation, and pressure is applied to the lamp housing component.

16. A method of using an illumination device, comprising: obtaining the illumination device of claim 9, rotating the lamp housing component relative to the battery housing component thereby engaging the threads, and applying pressure to the lamp housing component thereby closing the electrical pathway, and illuminating an object.

17. A method of making an illumination device comprising; obtaining a housing having a battery housing component and a lamp housing component, the battery housing component having threads on one end, further including an inner lumen capable of receiving and containing one or more batteries, and an electrically conductive pathway from the batteries to the lamp housing component; the lamp housing component having a threaded end and a light emitting end, and further comprising: one or more open ended lumens; interior features; a gasket adapted to the interior features, the gasket having a base that contacts the inner diameter of the lamp housing component, and the gasket further comprising one or more protrusions having through holes, the outer surface of the protrusions in contact with the inner surface of the open ended lumens in the lamp housing component; one or more light sources, the light sources positioned through the gasket protrusions and through the open ended lumens; a circuit board, the circuit board in electrical communication with the light sources and the batteries; a momentary switch incorporated into the electrical pathway between the light source and batteries; and a main connector shaft, the shaft positioned axially through the gasket and circuit board capable of securing and holding the lamp housing components; and assembling the components thereof.

* * * * *